US006531052B1

(12) United States Patent
Frye et al.

(10) Patent No.: US 6,531,052 B1
(45) Date of Patent: Mar. 11, 2003

(54) REGENERABLE ADSORBENT FOR REMOVING SULFUR SPECIES FROM HYDROCARBON FLUIDS

(75) Inventors: Robert A. Frye, Natchez, MS (US); Dana L. Rehms, Natchez, MS (US); Elise M. Mophett, Natchez, MS (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/680,362

(22) Filed: Oct. 5, 2000

(51) Int. Cl.[7] ..... C10G 25/12

(52) U.S. Cl. ..... 208/189; 208/208 R; 208/246; 208/250; 502/414

(58) Field of Search ..... 208/208 R, 189, 208/246, 213; 502/414, 347, 79

(56) References Cited

U.S. PATENT DOCUMENTS

| | | | | | |
|---|---|---|---|---|---|
| 4,101,631 | A | * | 7/1978 | Ambrosini et al. | 423/210 |
| 4,163,708 | A | | 8/1979 | Jacobson et al. | 208/89 |
| 4,430,205 | A | | 2/1984 | Felsky | 208/246 |
| 4,474,896 | A | * | 10/1984 | Chao | 502/216 |
| 4,762,537 | A | | 8/1988 | Fleming et al. | 55/71 |
| 5,053,209 | A | | 10/1991 | Yan | 423/210 |
| 5,454,933 | A | * | 10/1995 | Savage et al. | 208/212 |
| 5,458,861 | A | * | 10/1995 | Buchanan et al. | 423/244.1 |
| 5,951,851 | A | | 9/1999 | Poirier et al. | 208/213 |
| 6,027,636 | A | | 2/2000 | Poirier | 208/213 |
| 6,129,833 | A | * | 10/2000 | McCauley et al. | 208/113 |
| 6,271,173 | B1 | * | 8/2001 | Khare | 502/406 |

* cited by examiner

*Primary Examiner*—Bekir L. Yildirim
(74) *Attorney, Agent, or Firm*—Glenn E. Klepac

(57) ABSTRACT

Sulfur species are removed from hydrocarbon fluids by a process that includes contacting the fluid with a solid adsorbent having a porous substrate impregnated with silver oxide. The solid adsorbent preferably comprises activated alumina. The solid adsorbent may be regenerated with a two step process including:

1) heating the adsorbent in an inert atmosphere, preferably an atmosphere containing nitrogen, so that sulfur species are stripped from the adsorbent without oxidizing them, and 2) heating the adsorbent in an oxidizing atmosphere, preferably an atmosphere containing approximately 20% oxygen, so that the silver contained on the adsorbent is re-oxidized, forming silver oxide.

15 Claims, 2 Drawing Sheets

REGENERABLE ADSORBENT FOR REMOVING SULFUR SPECIES FROM HYDROCARBON FLUIDS

FIELD OF THE INVENTION

The present invention relates to adsorbents and processes for removing sulfur species from hydrocarbon fluids. More specifically, the invention relates to a regenerable adsorbent comprising alumina and silver oxide for adsorbing sulfur species from refined fuels.

BACKGROUND OF THE INVENTION

Naturally occurring petroleum generally contains varying amounts of sulfur compounds, including mercaptans and thiophenes. Transport of petroleum through a pipeline can also introduce elemental sulfur as an impurity. To avoid corrosion problems associated with elemental sulfur contamination, petroleum refining processes often are designed to convert the elemental sulfur impurities to separable organic disulfides and polysulfides. Sulfur species in liquid fuels have a corrosive effect on brass parts of valves, gauges, and fuel pumps. Also, sulfur species in refined fuels such as gasoline, kerosene, diesel fuel, and jet fuel are objectionable because combustion of the fuel converts sulfur species to sulfur oxides that are released to the atmosphere. Most refining processes change only the form of the sulfur, so that the products may still be objectionable because of their high sulfur content.

As used herein, the term "sulfur species" refers to all forms of sulfur compounds and elemental sulfur appearing in liquid fuels. The sulfur compounds in refined gasoline may include organic disulfides and polysulfides. Varying concentrations of aliphatic thiols, aromatic thiols, thiophenes and benzothiophenes are also present.

Adsorption processes for removing sulfur species from liquid hydrocarbons are known in the prior art. Some patents describing adsorption processes include Jacobson U.S. Pat. No. 4,163,708; Felsky U.S. Pat. No. 4,430,205; Poirier U.S. Pat. No. 5,951,851; and Poirier U.S. Pat. No. 6,027,636. One disadvantage of the known prior art adsorption processes is that their adsorbents are difficult to regenerate in an environmentally acceptable and economical way. Accordingly, there still remains a need for an efficient and economical process for removing sulfur species from hydrocarbon fluids. The need for such process is particularly timely because the U.S. Environmental Protection Agency has proposed new industry standards limiting sulfur content in gasoline, to be implemented in 2004.

A principal objective of the present invention is to provide a process for removing sulfur species from a hydrocarbon fluid, by contacting the fluid with an alumina-containing adsorbent impregnated with silver oxide.

A related objective of the invention is to provide a process for regenerating the alumina and silver oxide adsorbent of our invention.

Additional objectives and advantages of the present invention will become apparent to persons skilled in the art from the following detailed description of a particularly preferred embodiment.

SUMMARY OF THE INVENTION

In accordance with the present invention, there is provided a process for removing at least one sulfur species from a hydrocarbon fluid. The fluid is contacted with a solid adsorbent impregnated with silver oxide.

The hydrocarbon fluid preferably comprises a refined fuel. Examples of such fuels include gasoline, diesel fuel, kerosene, and jet fuel. The refined fuel is generally treated to convert some sulfur species to disulfides and polysulfides. The fuel may contain various amounts of other sulfur species, including elemental sulfur, mercaptans, thiophenes, and benzothiophenes.

The solid adsorbent substrate preferably comprises alumina or alumina combined with at least one other adsorbent selected from zeolite, clay, silica, hydrotalcite, and brucite. Most preferably, the substrate is comprised only of activated alumina. A solid adsorbent substrate comprising about 50–95 wt. % alumina and about 5–50 wt. % zeolite is also suitable. Another suitable solid adsorbent substrate is made with about 25 wt. % sodium Y-zeolite and about 75 wt. % alumina. The substrate preferably has more than about 200 $m^2/g$ surface area. Additional details of this solid adsorbent substrate are disclosed in Fleming et al. U.S. Pat. No. 4,762,537, the disclosure of which is incorporated herein by reference.

Various shapes of adsorbent substrates are suitable for use in the present invention, including balls, pellets, and irregularly shaped powders. Balls having an average diameter of about 0.2–5 mm are particularly preferred.

The solid adsorbent is prepared for adsorption of sulfur species by impregnating the substrate with an aqueous solution of a water-soluble silver compound, drying the adsorbent, and then oxidizing the silver compound to silver oxide. The water-soluble silver compound may be any water soluble silver salt, such as silver nitrate, silver fluoride, or silver acetate. Silver concentration in the aqueous solution should be about 0.1–2N. A 1N silver nitrate solution is utilized in a particularly preferred embodiment. Silver oxide contents in the solid adsorbent are obtained from elemental analysis using Proton Induced X-ray Emission (PIXE). Silver oxide content in the solid absorbent is about 1–20 wt. %. A particularly preferred solid adsorbent contains between 5 and 10 wt. % silver oxide.

One important advantage of the solid adsorbent described herein is that it can be regenerated easily, with the regenerated adsorbent retaining most of its activity. The used adsorbent is heated to an elevated temperature in an inert atmosphere, for example, an atmosphere containing nitrogen and less than about 1 vol. % oxygen, thereby stripping the sulfur species from the adsorbent without oxidizing them. After the adsorbent is heated in nitrogen it is again heated in an atmosphere containing oxygen, for example in air, thereby oxidizing the silver and removing any remaining sulfur species from the adsorbent. Heating in an oven for about 2 hours at about 500° C. is suitable, both for the step of heating in nitrogen and for the step of heating in air. The regenerated adsorbent retains at least about 70% of the original capacity to remove sulfur, and this regeneration is repeatable. Experimental tests have verified successful regeneration up to at least five cycles.

DETAILED DESCRIPTION OF PREFERRED EMBODIMENTS

Figure 1:
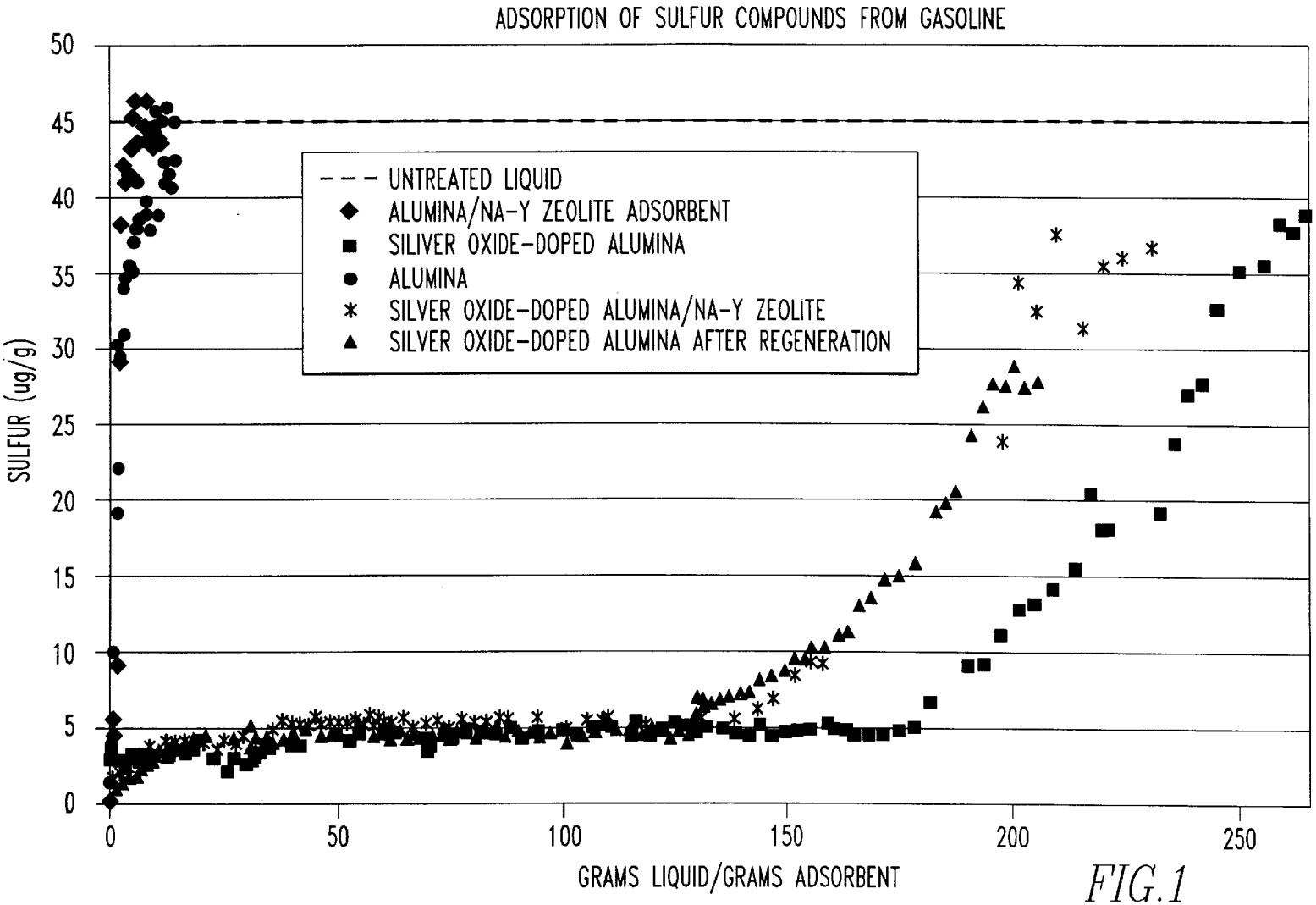
FIG. 1 is a graph of sulfur concentration in gasoline as a function of grams gasoline treated per gram of adsorbent.

In accordance with the present invention, a 20 g sample of alumina balls was placed in a beaker. The alumina balls had an average diameter in a range of about 1.4–2.8 mm (7×14 mesh size). The alumina balls were soaked in 50 ml of a 1N silver nitrate solution heated at 75° C. for 3 hours. The beaker was removed from heat and allowed to sit overnight. Excess liquid was decanted and the product was rinsed several times with deionized water and placed in a 100° C. oven for 12 hours. The dried adsorbent was then heated slowly in air to 450° C. and held at that temperature for 3 hours. The resulting yellowish-gray product was finally cooled in a desiccator at ambient temperature. Later experiments revealed that heating of the silver nitrate solution while soaking the substrate is not a critical part of the preparation, at least in the case of an alumina only substrate. Rinsing the adsorbent after impregnation with deionized water serves only to reduce the amount of particulate present, and does not affect adsorbent performance in sulfur removal tests.

Effectiveness of the adsorbent for removing sulfur species from gasoline was assessed in a series of laboratory tests. The adsorbent balls were crushed and screened to a uniform particle size of about 0.3–0.7 mm (28×48 mesh). A 2–3 g sample of the crushed adsorbent was placed in a glass column having a 0.5 inch outer diameter. The column was mounted vertically and equipped with a metering valve at the bottom to control the fluid flow rate. A 250 ml separatory funnel attached to the top of the column served as a reservoir. Known weights of unleaded gasoline containing approximately 45 ppm sulfur were added to the funnel. The gasoline was previously treated by a process that converted most of the sulfur present to disulfide and polysulfide compounds.

Gasoline passed through the adsorbent column at a rate of about 0.5 $cm^3$/min. Samples of about 0.5 ml gasoline were periodically analyzed for sulfur content by chemiluminescence. Gasoline was continuously added to the reservoir until the sulfur content in the treated liquid reached the sulfur content of the untreated gasoline. For comparison purposes, tests were also performed with two other adsorbents in the column-alumina without any silver oxide, and an alumina-zeolite blend without silver oxide.

Soon after the adsorbent column was saturated as evidenced by sulfur content in the treated gasoline equal to sulfur content of the gasoline going in, the used alumina/silver oxide adsorbent was regenerated and the experiment was repeated. A two-step regeneration process was employed. The used adsorbent was transferred from the glass column to a 0.5 inch other diameter steel tube and placed in an oven. In a first step, nitrogen gas (UHP grade) flowed through the adsorbent bed at approximately 1000 $cm^3$/min while the temperature was increased to 500° C. and held there for 2 hours. In a second step, air flowed across the adsorbent at 500° C. for 2 hours. The regenerated alumina/silver oxide adsorbent was allowed to cool and was returned to the glass column for a subsequent adsorption cycle.

Results of the tests summarized above are shown in FIG. 1. The figure is a graph of sulfur concentration in the liquid samples as a function of liquid to adsorbent ratio. The column containing the alumina/silver oxide adsorbent performed such that sulfur concentrations in the contacted gasoline did not reach the 45 ppm level in untreated gasoline until the liquid-to-adsorbent ratio reached nearly 280:1. The pure alumina adsorbent and the alumina Y-zeolite adsorbent performed much less. efficiently. Both adsorbents were saturated at a liquid-to-adsorbent ratio of less than 10:1.

The alumina-silver oxide adsorbent retained most of its sulfur-adsorbing capacity upon regeneration. The regenerated adsorbent saturated at a liquid-to-adsorbent ratio of about 225:1. Sulfur loadings for these experiments were calculated to be 0.9 wt. % for first contact on the alumina-silver oxide adsorbent and 0.6 wt. % after regeneration. Sulfur loadings on the unmodified alumina adsorbent and for the aluminazeolite adsorbent were both less than 0.04 wt. %.

Figure 2:
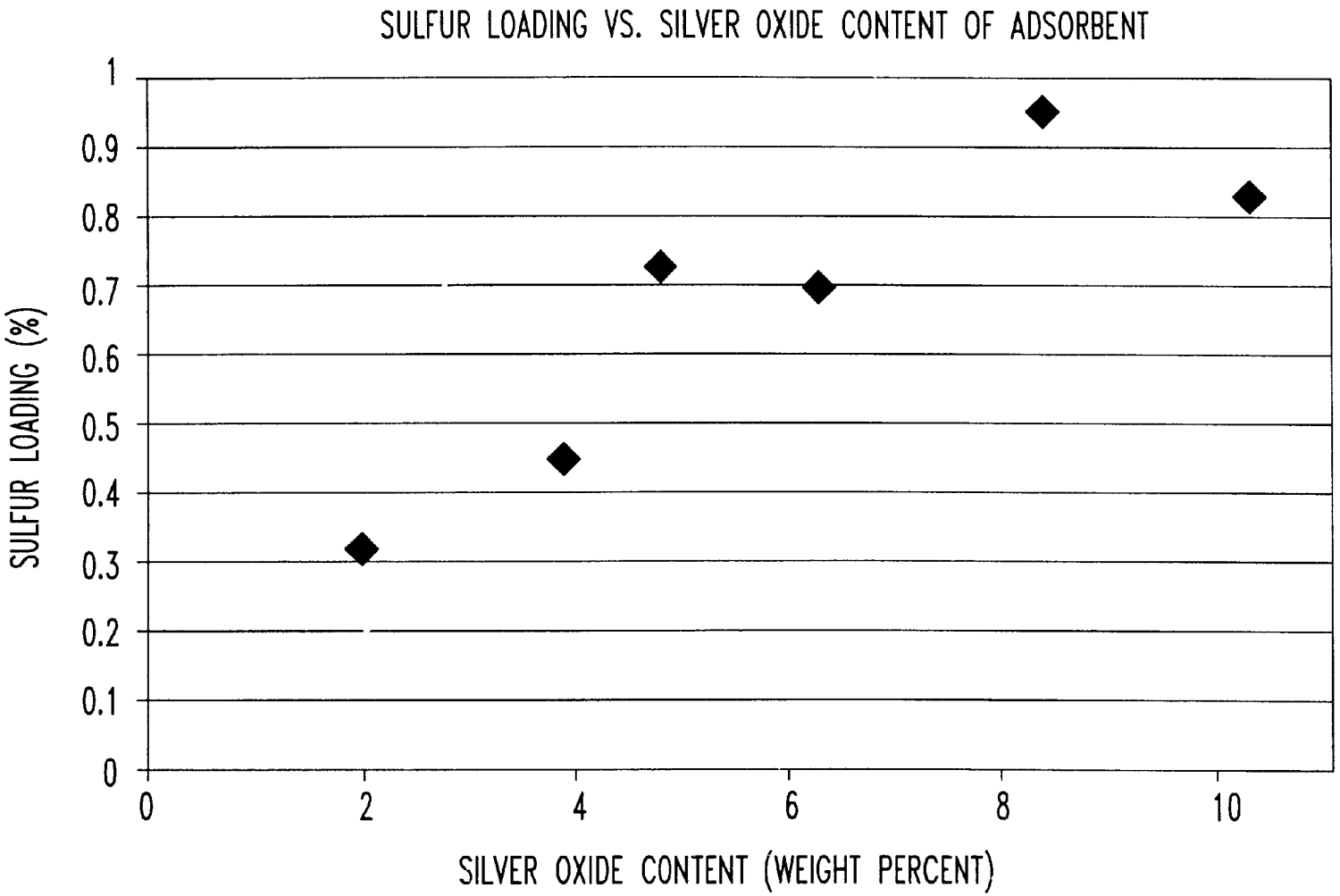
FIG. 2 displays sulfur loading of the adsorbent (weight %) as a function of silver oxide content (weight %) of the adsorbent.

Additional experiments were performed to investigate the effect of varying the silver oxide content of the alumina. Six different samples of silver oxide containing alumina were prepared in the same method as described above by using successively lower concentrations of silver nitrate solution. In particular, the six solutions were approximately 0.1, 0.2, 0.3, 0.6, 0.8, and 1.0 N aqueous silver nitrate. Upon soaking separate samples of alumina balls in the solutions (~20 g alumina: 50 ml liquid), six different silver oxide-alumina samples were produced with silver oxide concentrations of 2.0%, 3.9%, 4.8%, 6.3%, 8.4%, and 10.3% respectively. On each of the samples prepared, previously described sulfur removal tests were performed using the same gasoline. Efficient sulfur removal is dependent on the amount of silver oxide present in the alumina. FIG. 2 is a graph of sulfur loading as a function of percent silver on the alumina sample. Loadings range from 0.32% sulfur for the lowest concentration of silver in the adsorbent to nearly 1.0% sulfur for the 8.4% silver oxide adsorbent.

These experiments demonstrate that the silver oxide impregnated adsorbent of the present invention provides enhanced removal of disulfide and polysulfide species from gasoline.

Having described the presently preferred embodiments, it is to be understood that the invention may be otherwise embodied within the spirit and scope of the appended claims.

What is claimed is:

1. A process for removing at least one sulfur species from a liquid hydrocarbon fuel selected from the group consisting of gasoline, diesel fuel, kerosene, and jet fuel, said process comprising contacting said fuel with a solid adsorbent having a porous substrate impregnated with silver oxide, said substrate comprising alumina, and thereafter;

(a) regenerating said adsorbent by heating the adsorbent to an elevated temperature in an inert atmosphere, thereby to remove said sulfur species from said adsorbent without oxidizing said sulfur species.

2. The process of claim 1 wherein said sulfur species is selected from the group consisting of elemental sulfur, disulfides, polysulfides, mercaptans, thiophenes, benzothiophenes and mixtures thereof.

3. The process of claim 1 wherein said solid adsorbent comprises alumina and at least one other adsorbent selected from the group consisting of zeolite, clay, silica, hydrotalcite, and brucite.

4. The process of claim 1 wherein said solid adsorbent comprises alumina and Y-zeolite.

5. The process of claim 1 wherein said solid adsorbent is prepared by impregnating the porous substrate with an aqueous solution of a water-soluble silver compound, drying the adsorbent, and then oxidizing the silver compound to silver oxide.

6. The process of claim 5 wherein said aqueous solution is one of silver nitrate or of any water-soluble silver salt.

7. The process of claim 1 wherein said solid adsorbent comprises about 1–20 wt. % silver oxide.

8. The process of claim 1 wherein said inert atmospere comprises nitrogen and less than about 1 vol. % oxygen.

9. The process of claim 1, further comprising, after said heating in an inert atmosphere, heating the adsorbent to an elevated temperature in an atmosphere containing oxygen.

10. A process for removing sulfur species from a hydrocarbon fluid, comprising:

(a) contacting said fluid with a solid adsorbent comprising a porous substrate impregnated with a silver compound, said substrate comprising alumina, thereby to adsorb said sulfur species onto said adsorbent;

(b) regenerating said adsorbent by heating the adsorbent to an elevated temperature in an inert atmosphere, thereby to remove at least most said sulfur species from said adsorbent without oxidizing said sulfur species; and (c) thereafter, heating said adsorbent in an atmosphere containing oxygen.

11. The process of claim 10 wherein said adsorbent comprises alumina and about 1–20 wt. % silver oxide.

12. The process of claim 10 wherein said sulfur species is selected from the group consisting of elemental sulfur, disulfides, polysulfides, mercaptans, thiophenes, benzothiophenes, and mixtures thereof.

13. The process of claim 10 wherein said adsorbent comprises aluminium and at least one other adsorbent selected from the group consisting of zeolite, clay, silica, hydrotalcite, and brucite.

14. The process of claim 10 wherein said solid adsorbent comprises alumina, Y-zeolite, and about 1–20 wt. % silver oxide.

15. The process of claim 10 wherein said inert atmosphere comprises nitrogen and less than about 1 vol. % oxygen.

* * * * *

UNITED STATES PATENT AND TRADEMARK OFFICE

CERTIFICATE OF CORRECTION

PATENT NO. : 6,531,052 B1 
DATED : March 11, 2003
INVENTOR(S) : Robert A. Frye et al.

It is certified that error appears in the above-identified patent and that said Letters Patent is hereby corrected as shown below:

Column 6,
Lines 5-8, Claim 13 should read:
The process of claim 10 wherein said adsorbent comprises alumina and at least one other adsorbent selected from the group consisting of zeolite, clay, silica, hydrotalcite, and brucite.

Signed and Sealed this

Twelfth Day of August, 2003

JAMES E. ROGAN
*Director of the United States Patent and Trademark Office*